US011053032B1

(12) United States Patent
Evans

(10) Patent No.: US 11,053,032 B1
(45) Date of Patent: Jul. 6, 2021

(54) LIDDER DEVICE

(71) Applicant: Altria Client Services LLC, Richmond, VA (US)

(72) Inventor: James David Evans, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 485 days.

(21) Appl. No.: 15/439,709

(22) Filed: Feb. 22, 2017

Related U.S. Application Data

(60) Provisional application No. 62/298,226, filed on Feb. 22, 2016.

(51) Int. Cl.
*B65B 7/28* (2006.01)
*A24F 23/02* (2006.01)

(52) U.S. Cl.
CPC ..... *B65B 7/2807* (2013.01); *A24F 23/02* (2013.01); *B65B 7/285* (2013.01)

(58) Field of Classification Search
CPC ..... B65B 7/2807; B65B 7/285; B65G 15/14
USPC ..... 53/488, 316, 485, 489
See application file for complete search history.

(56) References Cited

U.S. PATENT DOCUMENTS 2,263,691 A * 11/1941 Enkur ..... B67B 3/24 53/407
2,340,639 A * 2/1944 Brinton ..... B65B 43/44 53/72
2,840,963 A * 7/1958 Osmond ..... B65B 7/2807 53/73
3,194,381 A * 7/1965 Sherman ..... B65B 11/105 198/419.3
3,460,314 A * 8/1969 Keas ..... B65B 7/2807 53/72
3,495,252 A * 2/1970 Hamlin ..... B65B 7/2842 53/70
4,122,649 A * 10/1978 Sawvel ..... B65B 7/2807 53/306
4,312,172 A * 1/1982 Fisher ..... B65B 7/2807 221/14
4,420,924 A * 12/1983 Hoyrup ..... B65B 7/2807 53/307
4,683,706 A * 8/1987 Harper ..... B65B 7/285 53/314
4,703,765 A * 11/1987 Paules ..... B65B 1/36 131/112
4,835,943 A * 6/1989 Mueller ..... B65B 7/2807 53/202
4,959,944 A * 10/1990 Heisler ..... B65B 7/2807 221/212
5,050,367 A * 9/1991 Heisler ..... B65B 7/2807 53/313
5,113,636 A 5/1992 Mihara et al.
5,937,616 A * 8/1999 Ray ..... B65B 7/2821 29/401.1

(Continued)

*Primary Examiner* — Dariush Seif
(74) *Attorney, Agent, or Firm* — Harness, Dickey & Pierce, P.L.C.

(57) ABSTRACT

A lidding station for containers, including a conveyor structured and arranged for moving unrestrained containers in a conveyance direction; a lid infeed chute above said conveyor; and first, second and third compression rollers positioned above said conveyor and downstream of said lid infeed chute, and methods for affixing lids to containers.

29 Claims, 3 Drawing Sheets

(56) References Cited

U.S. PATENT DOCUMENTS

| | | | | |
|---|---|---|---|---|
| 6,141,939 | A * | 11/2000 | Pedrotti | B65B 7/2814 53/314 |
| 6,219,996 | B1 * | 4/2001 | Searle | B65B 7/168 141/125 |
| 6,499,280 | B1 * | 12/2002 | Tsutsui | B65B 43/52 141/169 |
| 8,757,167 | B1 | 6/2014 | Jurczenia et al. | |
| 10,358,238 | B2 * | 7/2019 | Koppers | B65B 17/02 |
| 2016/0221697 | A1 * | 8/2016 | Koppers | B65B 35/54 |

* cited by examiner

LIDDER DEVICE

RELATED APPLICATION

This patent application claims priority to U.S. Provisional Application Ser. No. 62/298,226, filed on Feb. 22, 2016, the contents of which are hereby incorporated by reference in their entirety.

FIELD

The present disclosure generally relates to machines for applying lids to containers, such as containers for tobacco sachets.

ENVIRONMENT

Tobacco sachets or pouches offer an individual portion of tobacco that is to be placed under the upper lip for tobacco enjoyment. The ever-increasing use of smokeless tobacco and the advantages of having individual portions prepackaged in a suitable permeable pouch or packet, the individual packaging of these rather small pouches has become extremely difficult on a large scale, rapid production basis. Typically, tobacco sachets are loaded into cans which are individually and sequentially processed at a high speed.

Conventionally, product containers have often been filled and capped or sealed in sequential operations. Due to the risk of misalignment of the containers with the processing line, individual containers are constrained within fixed guides, such as apertures in the conveyor belts, container flights, slots or indexing wheels having cut-outs sized and shaped for specific containers. These custom designed systems are both expensive and relatively slow, especially when applying lids to the containers.

It would be desirable to provide an apparatus and method suitable for reliable, high-speed packaging, packaging efficiency and the attendant cost-reduction and which is configured for convenient adjustability to permit its use with differently sized containers and different packaging equipment for packaging tobacco sachets.

SUMMARY

The present disclosure includes an apparatus for applying container lids which is readily adaptable for high-speed use with a variety of existing packaging equipment, is desirably straightforward in operation, and is readily adjustable for use with differently sized containers.

Provided is a lidding station for containers, comprising a conveyor structured and arranged for moving, unrestrained containers in a conveyance direction, a lid infeed chute above said conveyor, and first, second and third compression rollers positioned above said conveyor and downstream of said lid infeed chute.

In one form, the conveyor comprises a cleated belt.

In another form, the conveyor comprises at least one set of side drive belts disposed laterally to and along the conveyance direction of the containers.

In another form, the conveyor comprises first and second sets of side drive belts, each set comprising drive belts disposed on opposite lateral sides along said conveyance direction. In this form, the first set of drive belts is driven at a slower speed than the second set of drive belts, and the second set of drive belts establishes a fixed distance between the containers.

In a preferred form, the lid infeed chute of the lidding station is structured and arranged to feed lids at an angle between about 10° to about 20° relative to the conveyor. The lid infeed chute can have a lid feed detent at the lower end of the chute, which is structured and arranged to retain a lid at the lower end of the lid infeed chute and deliver the lid into contact with a front lip of a container passing beneath the lid on the conveyor.

In one form, the first compression roller is structured and arranged to guide lids exiting the lid infeed chute onto tops of the containers on the conveyor, the second compression roller is structured and arranged lower than the first compression roller, to press the lids onto the containers, and the third compression roller is structured and arranged to restrict vertical movement of a leading edge of a single container during the pressing action of the second compression roller on the trailing edge of that container.

In another form, the lidding station can comprise a fourth compression roller, wherein the first compression roller is structured and arranged to guide lids exiting the lid infeed chute onto tops of the containers on the conveyor, the second and third compression rollers are structured and arranged lower than the first compression roller, to press the lids onto the containers, and the fourth compression roller is structured and arranged to restrict vertical movement of a leading edge of a single container during the pressing action of the second and third compression rollers on the trailing edge of that container.

In a preferred form, the compression rollers comprise resilient materials, such as polyurethane or rubber, and are free-rolling.

In another form, the compression rollers are supported within a carriage, the carriage is adjustable in the conveyance direction, and the compression rollers are individually biased vertically relative to the conveyor.

In a preferred form, the lidding station is structured and arranged to deposit and affix circular lids onto circular containers.

In another form, presented is a process of affixing lids to containers, comprising disposing a plurality of unrestrained containers at a fixed distance between adjacent containers on a conveyor, conveying the containers in a conveyance direction and under a lid infeed chute, serially depositing a lid on each container and pressing the lids onto the containers with at least first, second and third serially arranged compression rollers, and optionally with a fourth compression roller.

In another form, the conveyor is a cleated belt and the containers are driven in the conveyance direction by the cleats.

In yet another form, the conveyor comprises at least one set of side drive belts disposed laterally to and along the conveyance direction of the containers, and the side drive belts act to establish and maintain the fixed distance between adjacent containers, while driving the containers in the conveyance direction.

Advantageously, the second compression roller is vertically biased more strongly against a combination lid and container passing under it as compared to the remaining compression rollers, and acts to press and seal the lid onto the container.

In another form, the first compression roller guides the lids onto tops of the containers, the second compression roller presses the lids onto the containers, and the third compression roller restricts vertical movement of a leading edge of a single container during the pressing action of the second compression roller on the trailing edge of that container.

In another form, when there are four compression rollers, the second and third compression rollers are vertically biased more strongly against a combination lid and container passing under them as compared to the remaining compression rollers, and act to press and seal the lid onto the container.

In another form, when there are four compression rollers, the first compression roller guides the lids onto tops of the containers, the second and third compression rollers press the lids onto the containers, and the fourth compression roller restricts vertical movement of a leading edge of a single container during the pressing action of the second and third compression rollers on the trailing edge of that container.

In another form, presented is a method of applying a lid to a bottom of a container, comprising: aligning the lid with the bottom with a first roller; pressing the lid into a fully closed position with a second roller; and abating the tendency of the second roller to upset the container with a third roller.

Advantageously, the abating includes imparting a biasing action at the second and third rollers, the biasing action at the third roller being less than the biasing action at the second roller.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
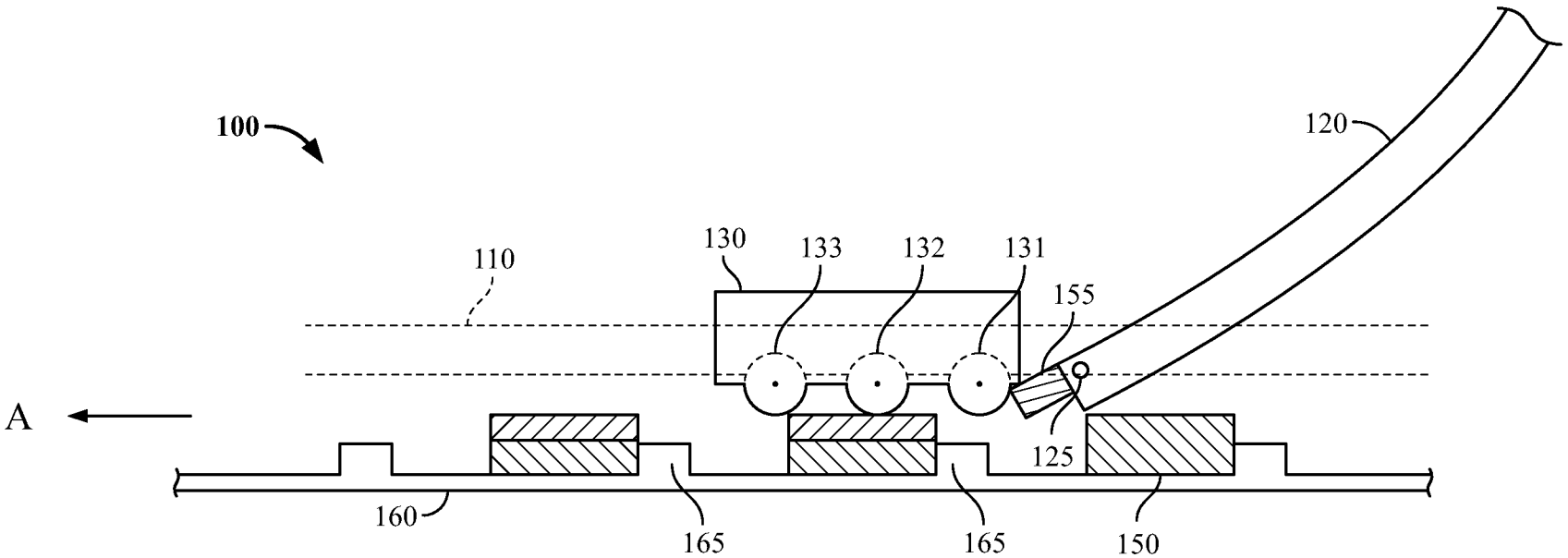
FIG. 1 presents a side view of the lidding station, in accordance with the present disclosure.
Figure 2:
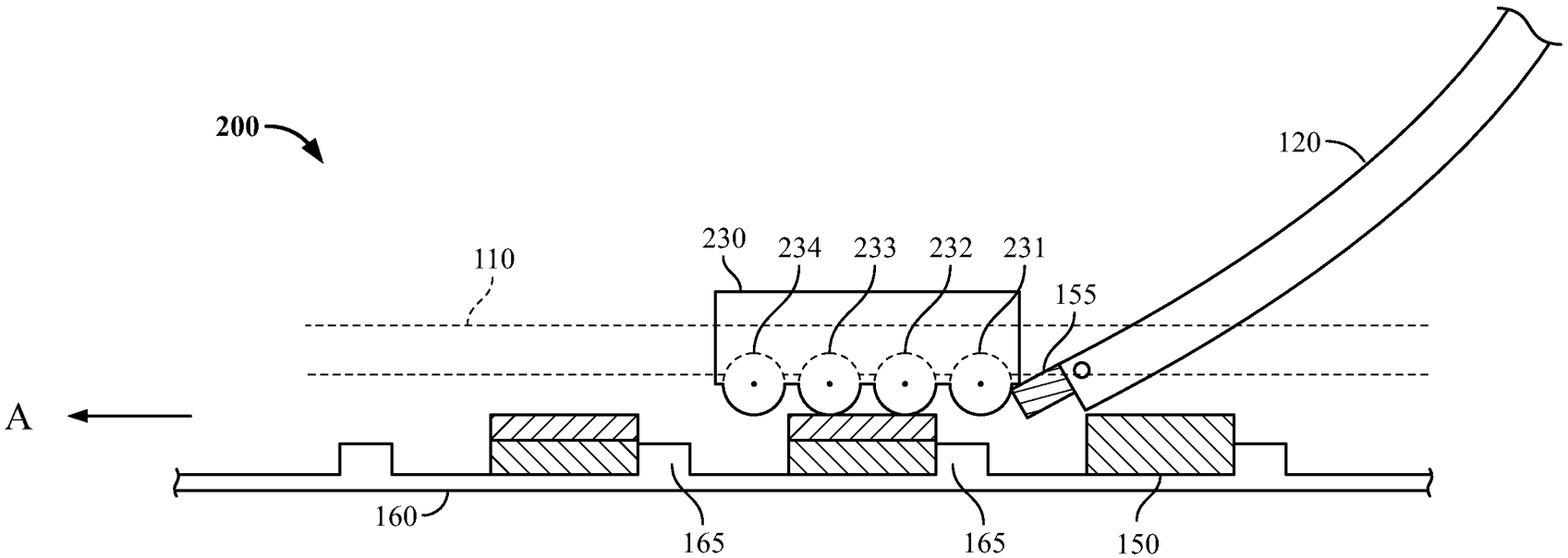
FIG. 2 presents a side view of an alternative lidding, in accordance with the present disclosure.
Figure 3:
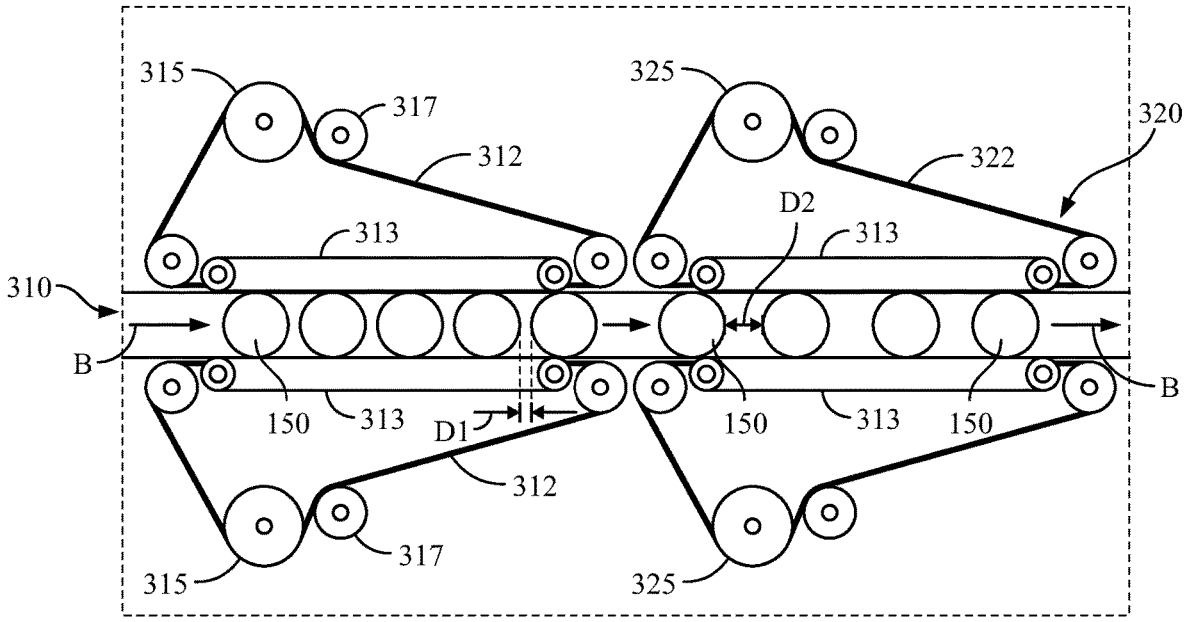
FIG. 3 presents a top view of an alternative embodiment of the conveyor means of the lidding station, in accordance with the present disclosure.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1-3, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Lidding stations which use a single roller to deposit and seal lids onto essentially unrestrained containers can act to lift the leading edge of the container vertically when the roller is only in contact with the trailing edge. In some cases such vertical displacement can result in misalignment of the unrestrained containers on the underlying conveyor and halting production to remove the shifted containers or realign the containers on the conveyor. Additionally, many lidding stations are configured to progress in a circular path, which adds complexity and slows the speed of the lidding process.

According to the present disclosure, a machine and process are provided which enable high speed deposition and sealing of lids onto free-standing, unrestrained containers travelling along a conveyor in a generally linear direction. The machine and process of the present disclosure are particularly advantageous, since the structure and arrangement of the conveyor and lidding station are flexible enough to accommodate a number of different-sized containers without major changes. Thus, the containers can be free-standing and substantially unrestrained when fed onto the conveyor and into the lidding station. For example, the containers can be individual cans containing tobacco sachets which have been deposited onto an upper surface of a moving conveyor, which does not need to be specially sized or greatly modified to accommodate other sizes of cans.

The process begins with a series of containers full of products being conveyed single file on the conveyor at fixed distances between them, such as at a distance of about 4 inches between each container. The conveyor enters a lidding station, the conveyor and thereby the containers centered under a lid infeed chute, which has a series of pre-formed lids stored therein in single file. Each lid slides down the chute and into contact with a lid detent disposed on the sides of the chute, such as ball or finger detents, where the lid is held in a proper position for contact with a leading edge of a container lip moving beneath it. The lids are delivered to the incorporation point at an angle of between about 15° to about 20°, the leading edge of the lid is contacted and captured by the leading edge of the underlying container, stripped out of the lid detent by movement of the container, and deposited onto the top of the container.

Subsequently, each lidded container progresses to a series of at least three and preferably four compression rollers supported in a carriage over the conveyor. The first roller helps to guide the lid onto the container; the middle roller(s), biased in the vertical direction to be a little lower than the first and last rollers, act to press the lid into sealing contact (full closure) on the container; and the last roller maintains the front edge of the container on the conveyor while the middle roller is sealing the back portion of the container/lid combination. Without this last roller, the compression force of the middle roller(s) on the trailing edge of a container tends to raise the leading edge of the container out of contact with the underlying conveyor, which can cause the container to become misaligned with the conveyor and interrupt the process. The compression rollers can be individually biased in the vertical direction within the carriage and relative to the underlying conveyor.

The compression rollers are essentially free-rolling and are not rotationally driven. Advantageously, they have at least outer surfaces which are made of a resilient material, such as polyurethane or rubber, which helps prevent deformation of the lids during the process.

The carriage which contains the compression rollers is adjustable in the direction of conveyance of the containers, such that the position of the rollers can be varied relative to the position of the infeed chute, such that the first compression roller contacts the leading edge of a lid shortly after it is pulled from the infeed chute by the leading edge of a container. This horizontal adjustment ability also accommodates variations in the lid and container sizes which can be processed through the lidding station.

In one embodiment the conveyor comprises a cleated belt, disposed horizontally below and linearly aligned with the lid infeed chute. Conventionally, the cleated belt is essentially continuous, and inverts itself on rollers at either end of the lidding station. The cleats on the belt help to push the cans through the apparatus and maintain a fixed distance between cans.

Alternatively, the conveyor can include a pair of opposing side belts, laterally mounted relative to the processing direction of the cans and above the plane of an underlying conventional (delivery) conveyor belt. The side belts can be "O-ring" style belts, or of any other suitable design which will act to move the cans between them by friction. In a preferred form, the conveyor includes two pair of opposing side belts. The first pair of opposing belts is driven at a slower speed than the underlying conveyor belt, and the second pair of opposing drive belts, linearly downstream from the first, is driven at the same line speed as a conveyor belt below the cans. In this manner, any cans which may have bunched together during infeed are separated upon transition from the lower speed belts to the higher speed belts running into the lidding station.

FIG. 1 presents a side view of the lidding station 100 of the present disclosure. The direction of travel is indicated by arrow A. Components of lidding station 100 are supported on frame 110, and include lid infeed chute 120, a carriage 130, and at least three compression rollers 131, 132 and 133, supported within carriage 130. Lid detent 125 is shown at the lower end of lid infeed chute 120, and pre-formed lids 155 exit the infeed chute 120 at an angle relative to a conveyor belt 160, such that the leading edge of lid 155 is captured by the leading edge 150*a* of moving can 150, pulling lid 155 past detent 125 and out of chute 120. Cleats 165 on conveyor belt 160 maintain gaps between and forward pressure on cans 150 as they progress through the lidding station and process. After a lid 155 is captured by a can 150, the lid is directed into better alignment with the can by first compression roller 131, and forced downward by compression roller 132 to seal the can, while compression roller 133 maintains the bottom leading edge of the can against conveyor belt 160, counteracting possible vertical movement of the front of the can which could be caused by compression of the following edge of the can by compression roller 132. Subsequently, the closed cans move out of lidding station 100 for further processing, packing and shipping.

In an embodiment, the first roller 131 is set at a height above the conveyor 160 such that it transitions (aligns) a can top 155 from its inclined orientation at the chute 120 to a horizontal one in registry over a can bottom 150. The second, intermediate roller 132, is positioned on the carriage at a distance closer to the conveyor 160 than the first roller 131 such that it presses the lid 155 to the fully closed (sealed) position onto the can bottom 150. Preferably, the third roller 133 is positioned on the carriage at distance above the conveyor 160 intermediate of the respective positions of the second and first rollers 132 and 131, such that it abates the tendency of the second roller 132 to otherwise lift a leading edge 150*a* portion of the can 150 as the can's trailing edge 150*b* portion passes beneath the second (intermediate) roller 132. In addition or in lieu of fixing the respective positions of the rollers as described, springs or other devices might be utilized to impart a downward biasing action upon the rollers such that they function similarly, that is, the first roller 131 would be biased downwardly to a degree sufficient to align the lid, the second (intermediate) roller 132 would be further biased downwardly to a degree sufficient to seal the lid and the third roller 133 would be biased downwardly to a lesser degree but sufficient to abate the tendency of the second roller 132 to upset the can (raise its leading edge) when the trailing edge portion passes underneath the second roller 132.

FIG. 2 presents a side view of an alternative lidding station 200 of the present disclosure, which has four compression rollers, 231-234, supported in carriage 230, but is otherwise similar in design and operation to the lidding station illustrated in FIG. 1.

FIG. 3 presents a top view of a feed mechanism of the lidding station, which may be used in cooperation with or as a substitute for the conveyor 160 of the embodiment of FIG. 1. The direction of travel in this figure is indicated by arrows B. Cans 150 are fed to side belt conveyor 320 by central belt 310 and into contact with infeed drive belts 312, which are conventionally driven by infeed drive motors 315 around end pulleys (not numbered) and infeed belt adjustment pulleys 317. Incoming cans 150 are centered in the system by adjustable belt guides 313. As can be seen in the figure, incoming cans can be bunched-up upon infeed, separated by a short distance $d_1$. In order to provide a consistent gap or distance between the cans, infeed drive belts 312 are driven at a slower speed, relative to lidding drive belts 322 downstream in the process. Upon transitioning from the infeed drive belts 312 to the lidding drive belts 322, cans 150 are separated a greater distance $d_2$, such as by about 4 inches, due to the difference in conveyor belt speeds, making the lidding process more reliable. The lidding drive belts 322 are driven by separate lidding section drive motors 325, but the remainder of the conveyor system in the lidding section is similar to that of the infeed conveyor system. The lidding station, while not shown in FIG. 3, is disposed above the lidding section of side drive belt conveyor 320, and operates as described above.

Advantageously, the side drive belt conveyor system of FIG. 3 can align and separate cans leaving multiple infeed lines which enter the lidding station in a bunched-together manner, and thus can feed the lidding station at a much faster rate than conventional conveyor systems. Additionally, the side-belt system of FIG. 3 can be readily adjusted to accept and convey containers of varying sizes.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

Illustrative, non-exclusive examples of assemblies, systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the consumer products industry and, in particular, to the tobacco products industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed:

1. A lidding station for containers, comprising:

a conveyor configured to move unrestrained containers in a conveyance direction;

a lid infeed chute above the conveyor;

a first spring-biased compression roller above the conveyor and downstream of the lid infeed chute, the first spring-biased compression roller configured to contact lids concurrently with the lid infeed chute to transition lids exiting the lid infeed chute from an inclined orientation at the lid infeed chute to a horizontal orientation on tops of the containers on the conveyor;

a second spring-biased compression roller above the conveyor and downstream of the first spring-biased compression roller; and a third spring-biased compression roller above the conveyor and downstream of the second spring-biased compression roller, the second spring-biased compression roller being configured to impart a greater downward biasing action than the first spring-biased compression roller and the third spring-biased compression roller.

2. The lidding station of claim 1, wherein the conveyor includes a cleated belt.

3. The lidding station of claim 1, wherein the conveyor includes at least one set of side drive belts disposed laterally to and along the conveyance direction of the containers.

4. The lidding station of claim 3, wherein the at least one set of side drive belts includes first and second sets of side drive belts, each set including drive belts disposed on opposite lateral sides along the conveyance direction.

5. The lidding station of claim 4, wherein the first set of drive belts is configured to be driven at a slower speed than the second set of drive belts, and the second set of drive belts is configured to establish a fixed distance between the containers.

6. The lidding station of claim 3, wherein the conveyor further includes a pair of adjustable belt guides.

7. The lidding station of claim 1, wherein the inclined orientation has an angle ranging from 10° to 20° relative to the conveyor.

8. The lidding station of claim 1, further comprising:

a lid feed detent at a lower end of the lid infeed chute, the lid detent being configured to retain a lid at the lower end of the lid infeed chute and deliver the lid into contact with a front lip of a container passing beneath the lid on the conveyor.

9. The lidding station of claim 8, wherein the detent includes a ball detent or a finger detent.

10. The lidding station of claim 1, wherein the second spring-biased compression roller is configured to press the lids onto the containers.

11. The lidding station of claim 10, wherein (i) the second spring-biased compression roller is configured to press on a trailing edge of a single container and (ii) the third spring-biased compression roller is configured to restrict vertical movement of a leading edge of the single container during (i).

12. The lidding station of claim 1, further comprising:

a fourth spring-biased compression roller.

13. The lidding station of claim 12, wherein the fourth spring-biased compression roller is positioned downstream of the second spring-biased compression roller and upstream of the third spring-biased compression roller, the fourth spring-biased compression roller being configured to impart a greater downward biasing action than the first spring-biased compression roller and the third spring-biased compression roller.

14. The lidding station of claim 13, wherein the second spring-biased compression roller and the fourth spring-biased compression roller are configured to press the lids onto the containers.

15. The lidding station of claim 14, wherein (i) the second spring-biased compression roller and the fourth spring-biased compression roller are configured to press on a trailing edge of a single container and (ii) the third spring-biased compression roller is configured to restrict vertical movement of a leading edge of the single container during (i).

16. The lidding station of claim 1, wherein the compression rollers comprise a resilient material.

17. The lidding station of claim 1, wherein the compression rollers comprise polyurethane or rubber.

18. The lidding station of claim 1, wherein the compression rollers are supported within a carriage, and the carriage is adjustable in the conveyance direction.

19. The lidding station of claim 1, wherein the compression rollers are free-rolling.

20. The lidding station of claim 1, wherein the lidding station is configured to deposit and affix circular lids onto circular containers.

21. The lidding station of claim 1, wherein the third spring-biased compression roller is configured to impart a greater downward biasing action than the first spring-biased compression roller.

22. A process of affixing lids to containers, comprising:

disposing a plurality of unrestrained containers at a fixed distance between adjacent containers on a conveyor;

conveying the containers in a conveyance direction and under a lid infeed chute;

serially depositing a lid on each container; and pressing the lids onto the containers with at least first, second and third serially arranged spring-biased compression rollers, the pressing including transitioning the lids from inclined orientations at the lid infeed chute to horizontal orientations on tops of the containers with the first spring-biased compression roller, wherein, the first spring-biased compression roller is configured to contact the lid concurrently with the lid infeed chute, the first spring-biased compression roller is above the conveyor and downstream of the lid infeed chute, the second spring-biased compression roller is above the conveyor and downstream of the first spring-biased compression roller, and the third spring-biased compression roller is above the conveyor and downstream of the second spring-biased compression roller, the second spring-biased compression roller being configured to impart a greater downward biasing action than the first spring-biased compression roller and the third spring-biased compression roller.

23. The process of claim 22, wherein the conveyor is a cleated belt and the conveying includes driving the containers in the conveyance direction by cleats of the cleated belt.

24. The process of claim 22, wherein the conveyor comprises at least one set of side drive belts disposed laterally to and along the conveyance direction of the containers, and the side drive belts are configured to establish and maintain the fixed distance between adjacent containers, while driving the containers in the conveyance direction.

25. The process of claim 22, wherein the compression rollers include polyurethane or rubber.

26. The process of claim 22, wherein the compressing includes vertically biasing the second spring-biased compression roller more strongly against a combination lid and container passing under it as compared to the remaining spring-biased compression rollers, and the second spring-biased compression roller is configured to press and seal the lid onto the container.

27. The process of claim 22, wherein the pressing includes pressing a trailing edge of a single container with the second spring-biased compression roller and restricting vertical movement of a leading edge of the single container with the third spring-biased compression roller during the pressing the trailing edge.

28. The process of claim 22, wherein the pressing further includes pressing the lids onto the containers with a fourth spring-biased compression roller downstream of the second spring-biased compression roller and upstream of the third spring-biased compression roller.

29. The process of claim 28, wherein the second and fourth spring-biased compression rollers are vertically biased more strongly against a combination lid and container passing under them as compared to the remaining compression rollers, and are configured to press and seal the lid onto the container.

* * * * *